US009462927B2

(12) United States Patent
Lee et al.

(10) Patent No.: US 9,462,927 B2
(45) Date of Patent: Oct. 11, 2016

(54) NOZZLE ASSEMBLY FOR DISHWASHER AND DISHWASHER HAVING THE SAME

(71) Applicant: Samsung Electronics Co., Ltd., Suwon-si, Gyeonggi-do (KR)

(72) Inventors: Chang Wook Lee, Seoul (KR); Hyung Kwen Ham, Jecheon-si (KR); Seung Oh Kim, Suwon-si (KR); Jung Yoon Hahm, Yongin-si (KR); Seung Gee Hong, Suwon-si (KR); Jea Won Lee, Hwaseong-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 138 days.

(21) Appl. No.: 14/019,981

(22) Filed: Sep. 6, 2013

(65) Prior Publication Data

US 2014/0069472 A1 Mar. 13, 2014

(30) Foreign Application Priority Data

Sep. 7, 2012 (KR) ..... 10-2012-0099443

(51) Int. Cl.
*A47L 15/23* (2006.01)
*A47L 15/42* (2006.01)
*A47L 15/22* (2006.01)

(52) U.S. Cl.
CPC ..... *A47L 15/428* (2013.01); *A47L 15/23* (2013.01); *A47L 15/22* (2013.01)

(58) Field of Classification Search
None
See application file for complete search history.

(56) References Cited

U.S. PATENT DOCUMENTS

| | | | | |
|---|---|---|---|---|
| 5,427,129 | A * | 6/1995 | Young et al. | 134/176 |
| 6,959,881 | B2 * | 11/2005 | Kim | 239/251 |
| 2004/0195361 | A1 | 10/2004 | Kim | |
| 2010/0224223 | A1 * | 9/2010 | Kehl et al. | 134/56 D |
| 2013/0180555 | A1 * | 7/2013 | Lee | A47L 15/428 134/181 |

FOREIGN PATENT DOCUMENTS

| | | |
|---|---|---|
| EP | 1050263 | 11/2000 |
| EP | 1882435 | 1/2008 |
| JP | 2-134125 | 5/1990 |

OTHER PUBLICATIONS

Extended European Search Report issued Nov. 7, 2013 in European Patent Application No. 13183434.3.

* cited by examiner

*Primary Examiner* — Michael Barr
*Assistant Examiner* — Cristi Tate-Sims
(74) *Attorney, Agent, or Firm* — Staas & Halsey LLP

(57) ABSTRACT

Disclosed herein are a nozzle assembly for a dishwasher capable of evenly spraying wash water in a wash tub and a dishwasher having the same. The dishwasher includes a sump to pump wash water, a supply pipe to which the wash water from the sump is supplied, and a nozzle assembly connected to the supply pipe. The nozzle assembly includes a lower rotor arm connected to the supply pipe, an upper rotor arm having a portion rotatably received in the lower rotor arm and having a first rotation center of an upper end thereof and a second rotation center of a lower end thereof positioned eccentrically from the first rotation center, and a nozzle rotatably connected to the upper rotor arm.

21 Claims, 11 Drawing Sheets

NOZZLE ASSEMBLY FOR DISHWASHER AND DISHWASHER HAVING THE SAME

CROSS-REFERENCE TO RELATED APPLICATIONS

This application claims the priority benefit of Korean Patent Application No. 10-2012-0099443, filed on Sep. 7, 2012 in the Korean Intellectual Property Office, the disclosure of which is incorporated herein by reference.

BACKGROUND

1. Field

Embodiments relate to a nozzle assembly for a dishwasher capable of evenly spraying wash water in a wash tub and a dishwasher having the same.

2. Description of the Related Art

A dishwasher is an appliance that automatically washes tableware, spoons, chopsticks and various cooking utensils (hereinafter, referred to as dishware) by removing food debris from dishware using a detergent and wash water.

In general, a dishwasher includes a main body, a wash tub disposed in the main body, a rack assembly withdrawably disposed in the wash tub, and a nozzle assembly to spray wash water. The rack assembly serves to accommodate dishware therein, and the dishware is washed by the wash water sprayed from the nozzle assembly.

The nozzle assembly is configured to spray wash water while rotating about a fixed point. The wash water from the nozzle assembly is sprayed in an arc, however, which may cause limitation in washing range. That is, sections which wash water does not reach may be present in a wash tub.

SUMMARY

In an aspect of one or more embodiments, there is provided a nozzle assembly capable of increasing a washing range in a wash tub using a rotor arm configured to eccentrically rotate and evenly spraying wash water in the wash tub by adjusting revolutions per minute of a nozzle body, and a dishwasher having such a nozzle assembly.

In an aspect of one or more embodiments, there is provided a dishwasher which includes a sump to pump wash water, a supply pipe to which the wash water from the sump is supplied, and a nozzle assembly connected to the supply pipe. The nozzle assembly includes a lower rotor arm connected to the supply pipe, an upper rotor arm having a portion rotatably received in the lower rotor arm and having a first rotation center of an upper end thereof and a second rotation center of a lower end thereof positioned eccentrically from the first rotation center, and a nozzle rotatably connected to the upper rotor arm.

At least one of the upper rotor arm and the nozzle may be provided with a friction part protruding therefrom, and revolutions per minute of the nozzle may be adjusted by an area of the friction part.

The upper rotor arm may be provided with a friction part protruding from an outer side surface thereof, the friction part being configured to contact an inner side surface of the lower rotor arm, and revolutions per minute of the upper rotor arm may be adjusted by an area of the friction part.

Frictional force between the upper rotor arm and the lower rotor arm and frictional force between the nozzle and the upper rotor arm may alternately increase or decrease.

If the frictional force between the upper rotor arm and the lower rotor arm exceeds the frictional force between the nozzle and the upper rotor arm, the nozzle may obtain force of rotating about an axis of the first rotation center of the upper end of the upper rotor arm.

If the frictional force between the upper rotor arm and the lower rotor arm exceeds the frictional force between the nozzle and the upper rotor arm, the upper rotor arm may obtain force of rotating about an axis of the second rotation center of the lower end of the upper rotor arm.

The nozzle may be provided with a plurality of spray holes having directivity at an upper surface thereof, and may be configured to rotate due to reaction to the wash water sprayed from the spray holes.

In an aspect of one or more embodiments, there is provided a nozzle assembly for a dishwasher which includes a rotor arm provided with a friction part and having a rotation center of an upper end thereof and a rotation center of a lower end thereof positioned eccentrically from the rotation center of the upper end, and a nozzle rotatably mounted to the rotor arm.

The nozzle may be provided with a connecting part, to which the rotor arm is connected, at a bottom surface thereof, and the connecting part may be provided with a friction part configured to contact the rotor arm.

The rotor arm may include an upper rotor arm connected to the nozzle, and a lower rotor arm in which at least a portion of the upper rotor arm is received.

The friction part may be provided at an outer side surface of the upper rotor arm.

The upper rotor arm may include a first body connected to the nozzle, a second body received in the lower rotor arm, and a third body to connect the first body and the second body such that a rotation center of the first body and a rotation center of the second body are positioned eccentrically from each other.

The first body, the second body and the third body may be integrally formed by injection molding.

The friction part may be provided at an outer side surface of the second body, and may be configured to contact an inner side surface of the lower rotor arm.

If wash water is supplied to the nozzle, the upper rotor arm may rotate in the lower rotor arm, and revolutions per minute of the upper rotor arm may be adjusted by a contact area of the friction part with the inner side surface of the lower rotor arm.

Revolutions per minute of the nozzle may be adjusted by a contact area of the friction part provided at an inner side surface of the connecting part with the rotor arm.

The first body may be provided with a fixing part protruding outwardly therefrom, and the nozzle may be provided with a hook at a bottom surface thereof. The upper rotor arm may be connected to the nozzle by the hook being hooked to the fixing part.

The first body may be provided with a hook at a portion thereof, and the lower rotor arm may be provided with a fixing part at a portion thereof. The upper rotor arm may be connected to the lower rotor arm by the hook being hooked to the fixing part.

The first body may be provided with a hook at an upper portion thereof, and the nozzle may be provided with a fixing part, to which the hook is hooked, at a bottom surface thereof. The fixing part may be configured as a recess having the same or larger radius than a radius of rotation of the hook in order to avoid interference of the hook when the nozzle rotates.

At least one of the rotor arm and the nozzle may be provided with a leakage guide, and the nozzle may rotate due to reaction force to water stream generated by the leakage guide.

As described above, the dishwasher may have an optimum washing range by adjusting the revolutions per minute with respect to revolution and rotation of the nozzle assembly using the friction parts of the rotor arm and the nozzle body.

In an aspect of one or more embodiments, there is provided a dishwasher including a sump to pump wash water; a supply pipe to which the wash water from the sump is supplied; and a nozzle assembly connected to the supply pipe. The nozzle assembly may include a rotor arm provided with a friction part and having a rotation center of an upper end thereof and a rotation center of a lower end thereof positioned eccentrically from the rotation center of the upper end; and a nozzle rotatably mounted to the rotor arm.

BRIEF DESCRIPTION OF THE DRAWINGS

These and/or other aspects will become apparent and more readily appreciated from the following description of embodiments, taken in conjunction with the accompanying drawings of which.

DETAILED DESCRIPTION

Figure 1:
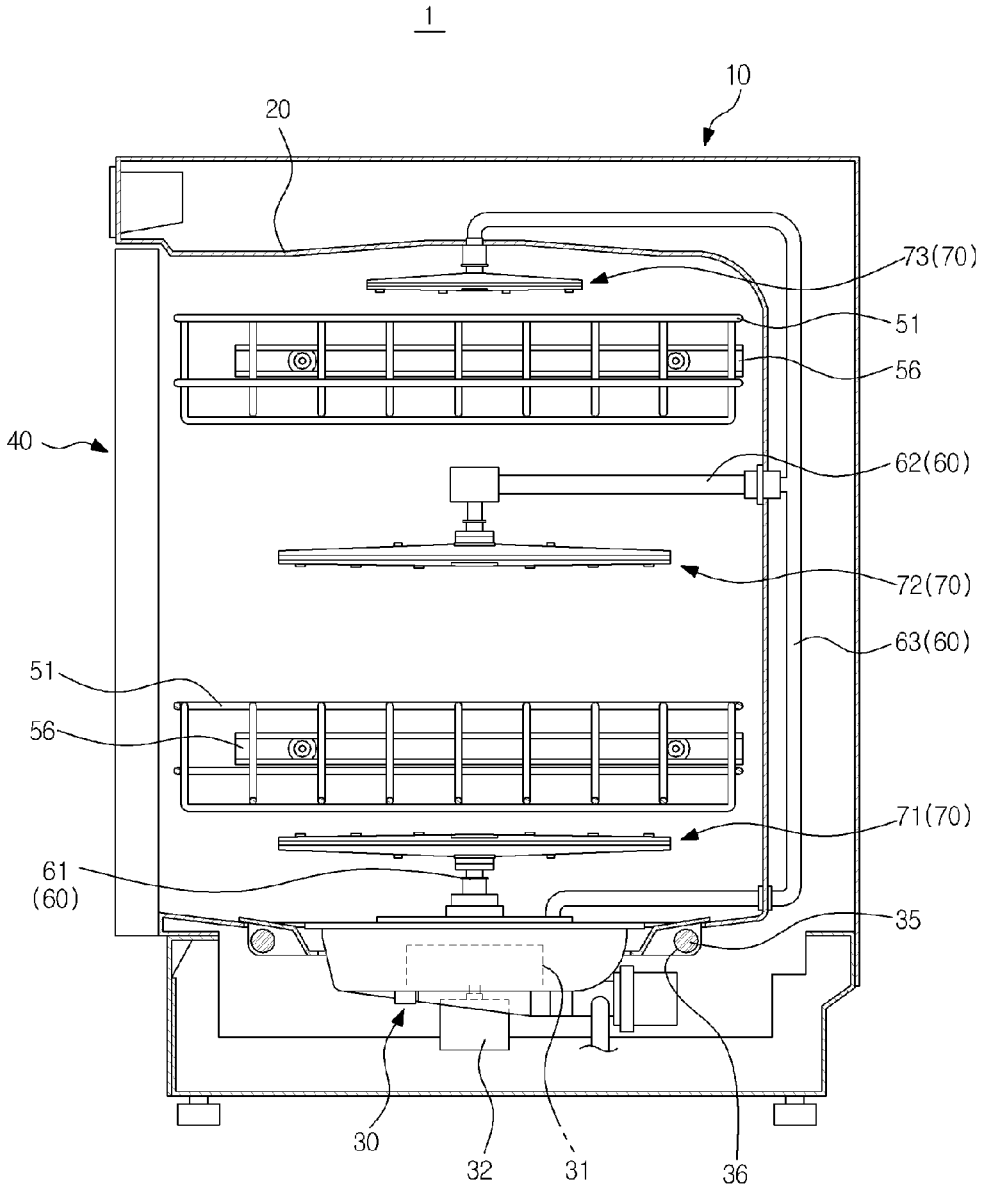
FIG. 1 is a view showing constitution of a dishwasher according to an embodiment.

Reference will now be made in detail to embodiments, examples of which are illustrated in the accompanying drawings, wherein like reference numerals refer to like elements throughout.

FIG. 1 is a view showing constitution of a dishwasher according to an embodiment.

As shown in FIG. 1, a dishwasher 1 includes a main body 10 to define an appearance thereof, a wash tub 20 disposed in the main body 10 to define a washing space for dishware, and a sump 30 installed under the wash tub 20 to store wash water therein.

The main body 10 has an opened side, which is opened and closed by swinging movement of a door 40. A lower end of the door 40 is hingedly coupled to a front lower portion of the main body 10.

Baskets 51 to accommodate dishware are withdrawably mounted in the wash tub 20. The baskets 51 are supported by guide rails 56 and may slide along the guide rails 56. The baskets 51 may be formed by wires arranged in a lattice so that the dishware accommodated in the baskets 51 may be exposed outside the baskets 51 and be washed.

A nozzle 70 is installed in the wash tub 20 in order to spray wash water toward the dishware accommodated in the baskets 51 to be washed. The nozzle 70 may be rotatably installed above or below the baskets 51 to spray wash water toward the baskets 51.

In such a case that two baskets 51 are provided in a vertical direction, i.e., when an upper basket and a lower basket are provided, the nozzle 70 may include a first nozzle 71, a second nozzle 72 and a third nozzle 73. The first nozzle 71 may be positioned below the lower basket and may spray wash water upward. The second nozzle 72 may be positioned between the lower basket and the upper basket and may spray wash water upward or downward. The third nozzle 73 may be positioned above the upper basket and may spray wash water downward.

The sump 30 disposed under the wash tub 20 holds wash water and pumps the same. The sump 30 includes a wash pump 31 to pump wash water at a high pressure, and a pump motor 32 to drive the wash pump 31.

The nozzle 70 is connected to the sump 30 by a supply pipe 60, and is supplied with wash water from the sump 30. When the nozzle 70 includes the first nozzle 71, the second nozzle 72 and the third nozzle 73 as described above, the supply pipe 60 includes a first supply pipe 61 to connect the sump 30 to the first nozzle 71, a third supply pipe 63 to connect the sump 30 to the third nozzle 73, and a second supply pipe 62 extending from the third supply pipe 63 to connect the third supply pipe 63 to the second nozzle 62.

The dishwasher 1 may further include a heater 35 to heat wash water. The heater 35 may be received in a heater receiving recess 36 formed under the wash tub 20.

The sump 30 may include a turbidity sensor (not shown) to detect the degree of contamination of wash water. A control unit (not shown) of the dishwasher 1 may detect the degree of contamination of wash water using the turbidity sensor, and may control the number of washing or rinsing processes. That is, the number of washing or rinsing processes may increase when the degree of contamination is high, and the number of washing or rinsing processes may decrease when the degree of contamination is low.

Figure 2:
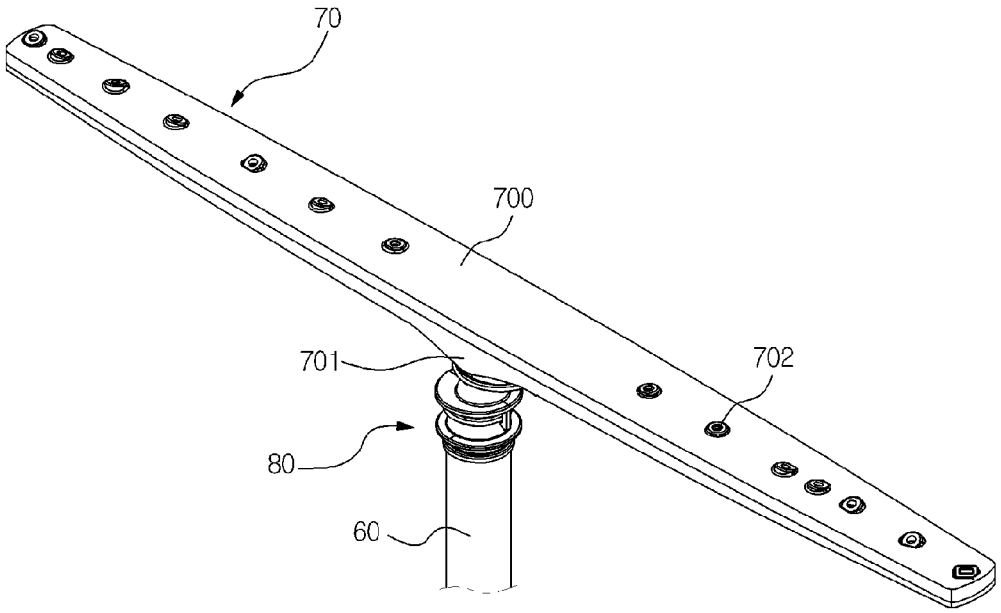
FIG. 2 is a perspective view showing connection of a nozzle assembly and a supply pipe according to an embodiment.

FIG. 2 is a perspective view showing connection of the nozzle assembly and the supply pipe according to an embodiment.

Referring to FIG. 2, the nozzle 70 is connected to the supply pipe 60 by a rotor arm 80. The wash water supplied from the sump 30 may be transmitted to the nozzle 70 through the supply pipe 60. The assembly of the nozzle 70 and the rotor arm 80 is defined as a nozzle assembly.

The nozzle 70 includes a nozzle body 700, a connecting part 701 and a spray hole 702. At least one spray hole 702 may be formed at a top surface or a bottom surface of the nozzle body 700. For example, the spray hole 702 may be formed at a top surface of the first nozzle 71, both a top surface and a bottom surface of the second nozzle 72, and a bottom surface of the third nozzle 73. Hereinafter, an exemplary embodiment in which the spray hole 702 is formed at the top surface of the nozzle body 700 will be described.

The spray hole 702 may be formed to have directivity. The spray hole 702 may be configured to spray wash water in a slanted direction with respect to a direction perpendicular to the top surface of the nozzle body 700. Due to reaction to the wash water spraying force of the spray hole 702 in a slanted direction, the nozzle body 700 may rotate in the opposite direction thereto. Since the rotating movement of the nozzle body 700 due to the reaction to the wash water spraying force of the spray hole 702 may be achieved by a conventional constitution, detailed explanation thereof will be omitted.

The connecting part 701 may be provided at the bottom surface of the nozzle body 700. The connecting part 701 may be configured as a rib protruding from the bottom surface of the nozzle body 700. The rib may have a shape corresponding to an external shape of a top portion of the rotor arm 80. The inner side surface of the connecting part 701 may contact the outer side surface of the top portion of the rotor arm 80.

The nozzle body 700 may be formed with an opening 720 (refer to FIG. 6) at the bottom surface thereof, and the connecting part 701 may be formed along the periphery of the opening 720. When the rotor arm 80 is connected to the connecting part 701, the opening 720 may communicate with hollow portions 810 and 820 (refer to FIG. 3) of the rotor arm 80.

One end of the rotor arm 80 may be connected to the connecting part 701 provided at the nozzle body 700, and the other end of the rotor arm 80 may be connected to the supply pipe 60. The wash water supplied from the sump 30 is fed to the nozzle body 700 through the supply pipe 60 and the rotor arm 80, and is sprayed through the spray hole 702 formed at the nozzle body 700.

Figure 3:
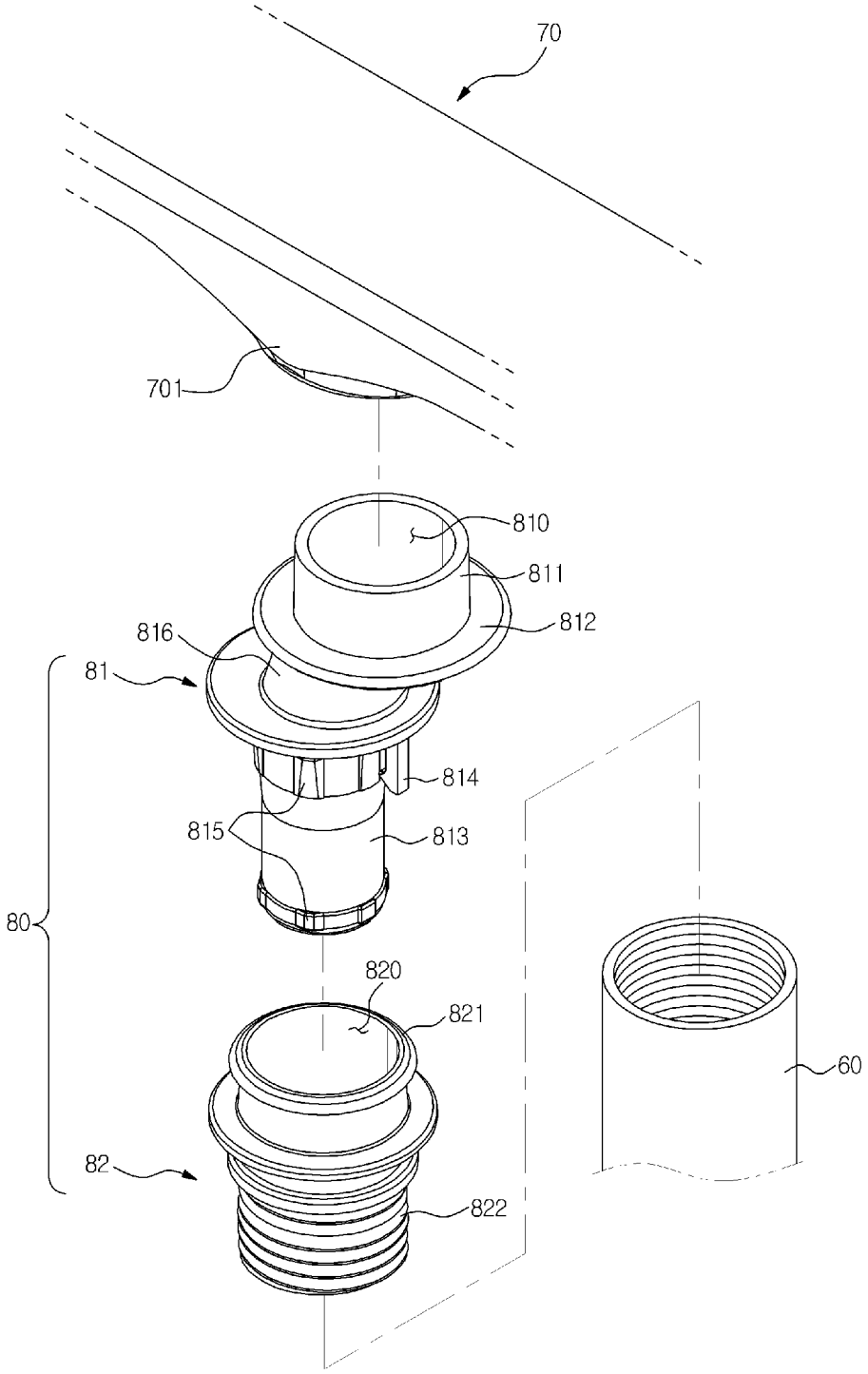
FIG. 3 is an exploded perspective view showing the nozzle assembly depicted in FIG. 2.
Figure 4:
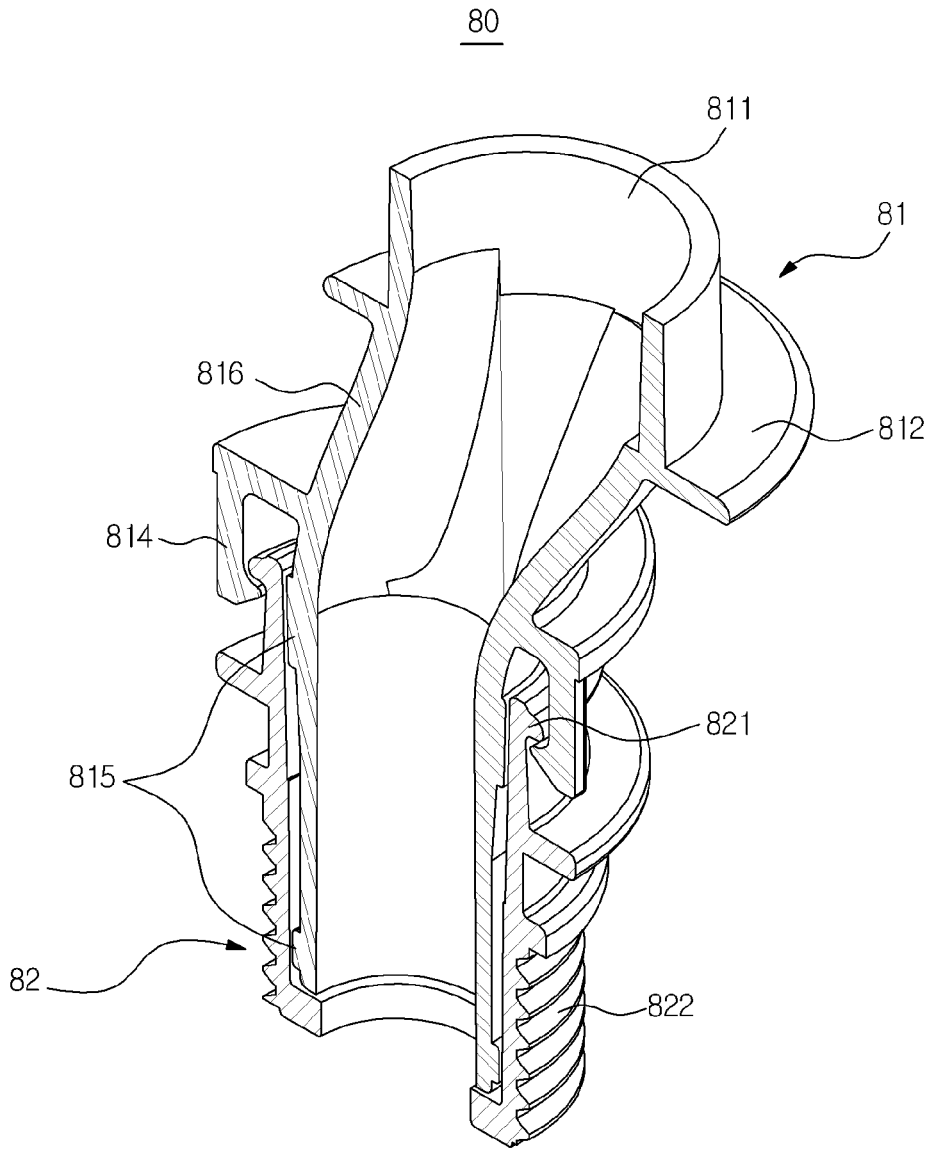
FIG. 4 is a sectional view showing a rotor arm according to an embodiment.
Figure 5:
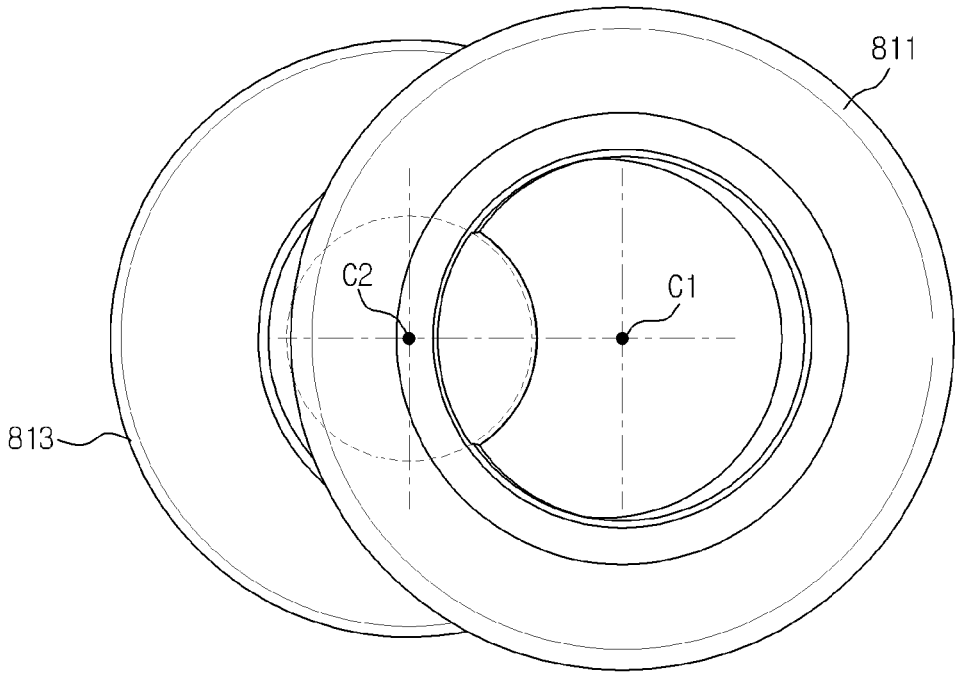
FIG. 5 is a view showing a relation of a first body and a second body of an upper rotor arm according to an embodiment.
Figure 6:
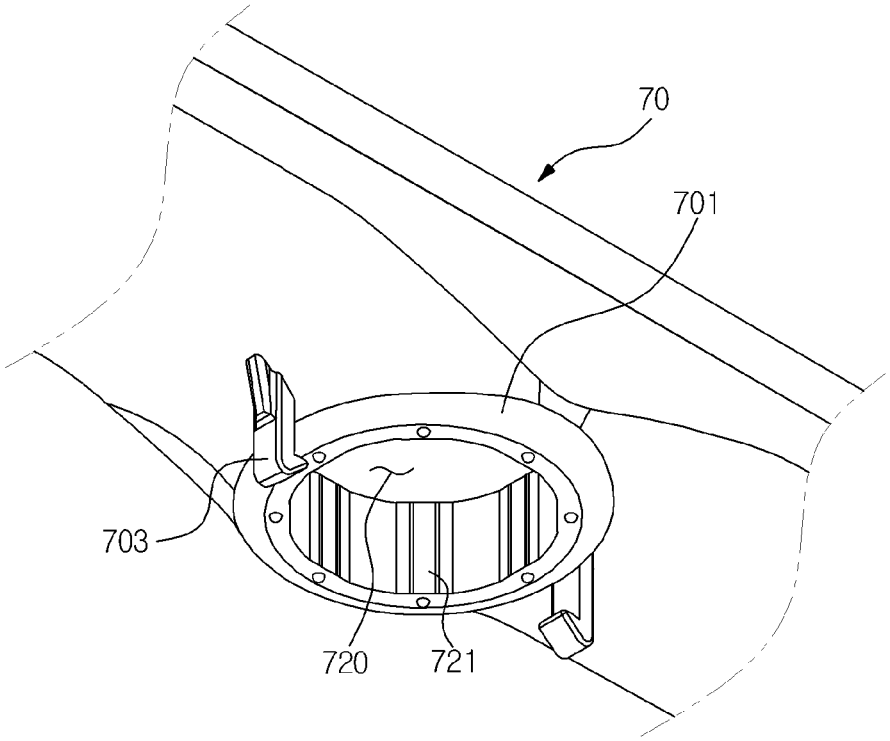
FIG. 6 is a view showing a bottom surface of a nozzle according to an embodiment.
Figure 7:
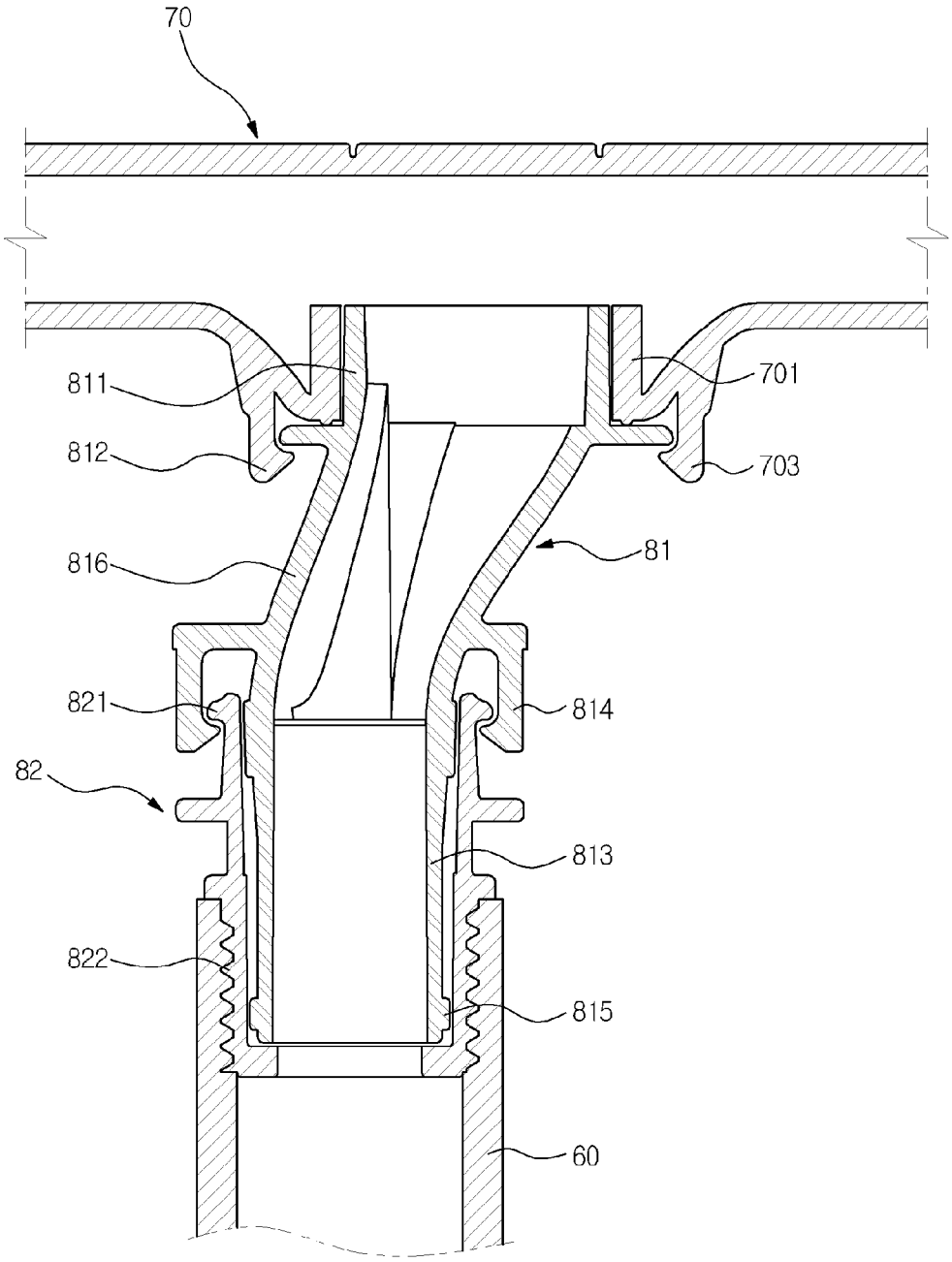
FIG. 7 is a sectional view showing the nozzle assembly according to an embodiment.

FIG. 3 is an exploded perspective view showing the nozzle assembly depicted in FIG. 2, FIG. 4 is a sectional view showing the rotor arm according to an embodiment, FIG. 5 is a view showing a relation of a first body and a second body of an upper rotor arm according to an embodiment, FIG. 6 is a view showing the bottom surface of the nozzle according to an embodiment, and FIG. 7 is a sectional view showing the nozzle assembly according to an embodiment.

Referring to FIGS. 3 through 7, the rotor arm 80 includes an upper rotor arm 81 and a lower rotor arm 82. An upper end of the upper rotor arm 81 is connected to the connecting part 701 provided at the bottom surface of the nozzle body 700, and a lower end of the lower rotor arm 82 is connected to the supply pipe 60.

The upper rotor arm 81 and the nozzle body 700 may be connected to each other using a hook structure. The lower rotor arm 82 and the supply pipe 60 may be connected to each other using a screw coupling structure such that a thread 822 formed at an outer side surface of the lower rotor arm 82 is tooth-engaged with a thread formed at an inner side surface of the supply pipe 60. The upper rotor arm 81 and the lower rotor arm 82 may be connected to each other using a hook structure. However, the connecting structures between the upper rotor arm 81 and the nozzle body 700, between the lower rotor arm 82 and the supply pipe 60, and between the upper rotor arm 81 and the lower rotor arm 82 are not limited to the aforementioned structures.

The upper rotor arm 81 includes a first body 811, a second body 813 and a third body 816. The first body 811 and the second body 813 may be formed in a hollow cylindrical shape, and may be connected to each other by the third body 816. The first body 811, the second body 813 and the third body 816 may be integrally formed by injection molding.

The first body 811, the second body 813 and the third body 816 are connected so as to form a communicating hollow portion 810. A central axis of the first body 811 is parallel with a central axis of the second body 813. The third body 816 connects the first body 811 and the second body 813 such that a rotation center C1 of the first body 811 is positioned eccentrically from a rotation center C2 of the second body 813.

The upper end of the first body 811 may be connected to the connecting part 701 of the nozzle body 700. In detail, the first body 811 may be inserted into the connecting part 701 such that the outer side surface of the first body 811 may contact the inner side surface of the connecting part 701. In more detail, the inner side surface of the connecting part 701 may be provided with a friction part 721, and the outer side surface of the first body 811 may contact the friction part 721. The friction part 721 may be configured as at least one protrusion provided at the inner side surface of the connecting part 701. By adjusting a contact area of the friction part 721 with the inner side surface of the first body 811, revolutions per minute (RPM) of the nozzle body 700 may be controlled. The control process of the RPM of the nozzle body 700 will be described later. The position of the friction part 721 is not limited to the inner side surface of the connecting part 701. The friction part 721 may be provided at the outer side surface of the first body 811 configured to contact the inner side surface of the connecting part 701. The configuration in which the friction part 721 is provided at the inner side surface of the connecting part 701 will now be described.

The first body 811 and the nozzle body 700 may be connected to each other using a hook structure. A hook 703 (refer to FIG. 6) may be provided at the bottom surface of the nozzle body 700, and a fixing part 812 to which the hook 703 is hooked may be provided at the first body 811. The fixing part 812 may be protrudingly provided at the outer side surface of the first body 811. The fixing part 812 may be formed in a ring shape protruding from the outer periphery of the first body 811. Because the hook 703 may be configured to rotate together with the nozzle body 700, the fixing part 812 may have the same or larger radius than a radius of rotation of the hook 703. The connecting structure of the first body 811 and the nozzle body 700 is not limited to this structure.

The nozzle body 700 may rotate about the rotation center C1 of the first body 811. In one or more embodiments, the nozzle body 700 may rotate about the axis of the rotation center C1 of the first body 811.

The second body 813 is provided under the first body 811. A friction part 815 may be provided at the outer side surface of the second body 813. The friction part 815 may contact the inner side surface of the lower rotor arm 82. The friction part 815 may be configured as at least one protrusion provided at the outer side surface of the second body 813. However, the friction part 815 is not limited to this configuration. The friction part 815 may be provided at the inner side surface of the lower rotor arm 82 configured to contact the outer side surface of the second body 813. The configuration in which the friction part 815 is provided at the outer side surface of the second body 813 will now be described.

A hook 814 may be provided at a portion of the upper rotor arm 81 to connect the lower rotor arm 82 to the upper rotor arm 81. The upper rotor arm 81 and the lower rotor arm 82 may be connected in such a manner that the hook 814 is hooked to a fixing part 821 provided at the outer side surface of the lower rotor arm 82.

The lower rotor arm 82 may be formed in a cylindrical shape having a hollow portion 820 therein. The second body 813 of the upper rotor arm 81 may be inserted into the hollow portion 820 of the lower rotor arm 82. When the second body 813 is inserted into the hollow portion 820, the friction part 815 provided at the outer side surface of the second body 813 may contact the inner side surface of the lower rotor arm 82.

The fixing part 821, to which the hook 814 provided at the first body 811 is hooked, may be formed by protruding from the top of the lower rotor arm 82. A thread 822 may be provided at the outer side surface of the lower rotor arm 82. In addition, the inner side surface of the supply pipe 60 may be provided with a thread corresponding to the thread 822 of the lower rotor arm 82. The thread on the inner side surface of the supply pipe 60 may be tooth-engaged with the thread 822 on the outer side surface of the lower rotor arm 82. That is, the lower rotor arm 82 and the supply pipe 60 may be coupled to each other using a screw coupling structure. However, the engagement structure of the lower rotor arm 82 and the supply pipe 60 is not limited to this screw engagement structure.

The second body 813 of the upper rotor arm 81 inserted into the hollow portion 820 of the lower rotor arm 82 may rotate about the rotation center C2. By adjusting a contact area of the friction part 815 of the second body 813 with the inner side surface of the lower rotor arm 82, the RPM of the upper rotor arm 81 may be controlled. The control process of the RPM of the upper rotor arm 81 will be described later.

Due to reaction to the wash water spraying force of the spray hole 702 in one direction, the nozzle body 700 may rotate in the opposite direction thereto. Accordingly, the nozzle body 700 may rotate about the axis of rotation center C1 of the first body 811 of the upper rotor arm 81, and may revolve around the axis of rotation center C2 of the second body 813.

Figure 8:
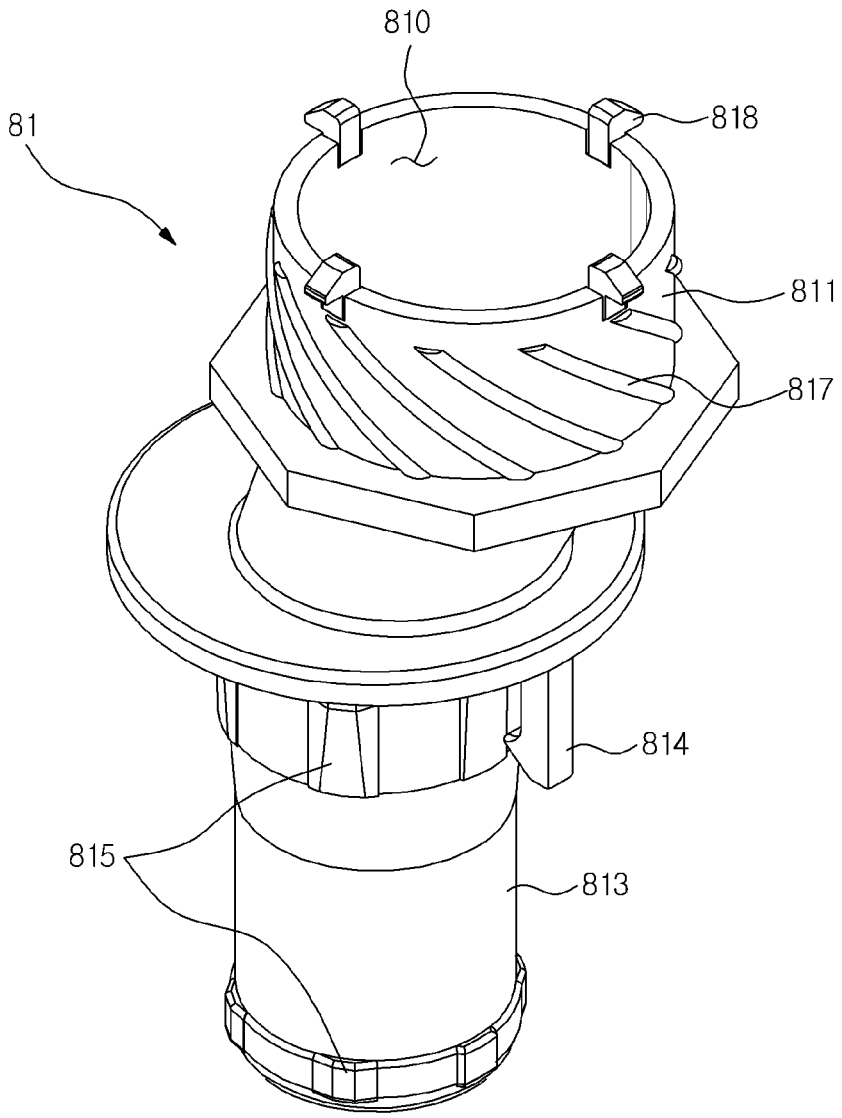
FIG. 8 is a perspective view showing an upper rotor arm according to an embodiment.
Figure 9:
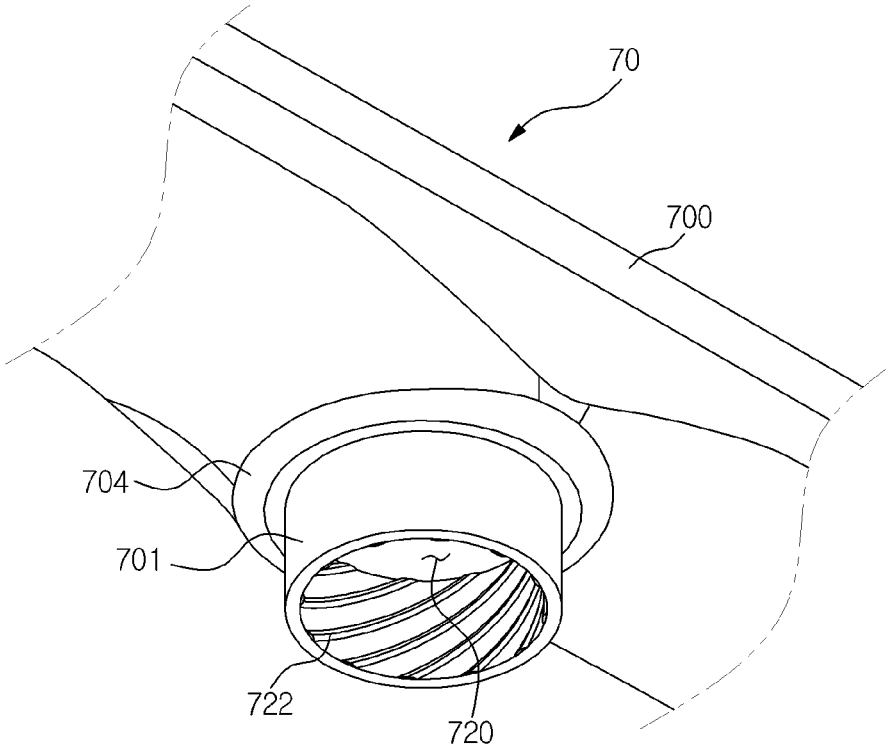
FIG. 9 is a view showing a bottom surface of a nozzle according to an embodiment.

FIG. 8 is a perspective view showing an upper rotor arm according to an embodiment, and FIG. 9 is a view showing a bottom surface of a nozzle according to an embodiment.

Referring to FIGS. 8 and 9, a leakage guide 817 or 722 may be provided at the upper rotor arm 81 or the connecting part 701 of the nozzle body 700. The leakage guide 817 or 722 may be provided at the outer side surface of the first body 811 of the upper rotor arm 81 or the inner side surface of the connecting part 701 of the nozzle body 700.

The leakage guide 817 or 722 may be provided in plural separate parts which protrude from the outer side surface of the first body 811 or the inner side surface of the connecting part 701. The leakage guide 817 or 722 may be configured as slanted protrusions having a certain length and provided at the first body 811 or the connecting part 701.

For example, the leakage guide 817 provided at the first body 811 may be configured as linear protrusions having a certain length and slanted such that an angle between a line connecting an upper end and a lower end of the linear protrusion and the axis of the rotation center C1 of the first body 811 is acute or obtuse. Similarly, when the first body 811 is inserted into the connecting part 701, an angle between a line connecting an upper end and a lower end of the linear protrusion of the leakage guide 722 provided at the connecting part 701 and the axis of the rotation center C1 of the first body 811 may be acute or obtuse.

Since the leakage guide 817 or 722 has directivity as described above, wash water may flow with directivity between the first body 811 and the connecting part 701, and the nozzle body 700 may rotate by the wash water flowing with directivity.

The leakage guide 817 provided at the first body 811 and the leakage guide 722 provided at the connecting part 701 may be directed differently from each other. For example, the leakage guide 817 provided at the outer side surface of the first body 811 may be configured as plural linear protrusions slanted upward to the left, and the leakage guide 722 provided at the inner side surface of the connecting part 701 may be configured as plural linear protrusions slanted upward to the right.

If wash water is supplied from the sump 30 to the nozzle 70, the wash water flows between the first body 811 and the connecting part 701, and water stream is generated by the leakage guide 817. The nozzle body 700 may rotate due to reaction force to the water stream. The RPM of the nozzle body 700 may be adjusted by modifying the angle and shape of the leakage guide 817 or 722. From a point of view that the RPM of the nozzle body 700 is adjusted by frictional force, the leakage guide 817 may be considered a sort of friction member.

A hook 818 may be provided at the top of the first body 811, and a fixing part 704 to which the hook 818 is hooked may be provided at the top of the connecting part 701. When the first body 811 is inserted into the connecting part 701, the hook 818 is hooked to the fixing part 704, thereby securely connecting the first body 811 to the nozzle body 700 without unexpected separation. In order to prevent interference of the hook 818 with other parts of the nozzle body 700 when the nozzle body 700 rotates, the fixing part 704 may be configured as a ring-shaped recess having the same or larger radius than a radius of rotation of the hook 818. However, the connecting structure of the first body 811 and the nozzle body 700 is not limited to this structure. The hook may be provided at the bottom surface of the nozzle body 700, and the hook may be hooked to the fixing part provided at the first body 811, to thereby securely connect the first body 811 to the nozzle body 700 without unexpected separation.

Hereinafter, the rotation of the nozzle assembly according to an embodiment will be explained.

Figure 10:
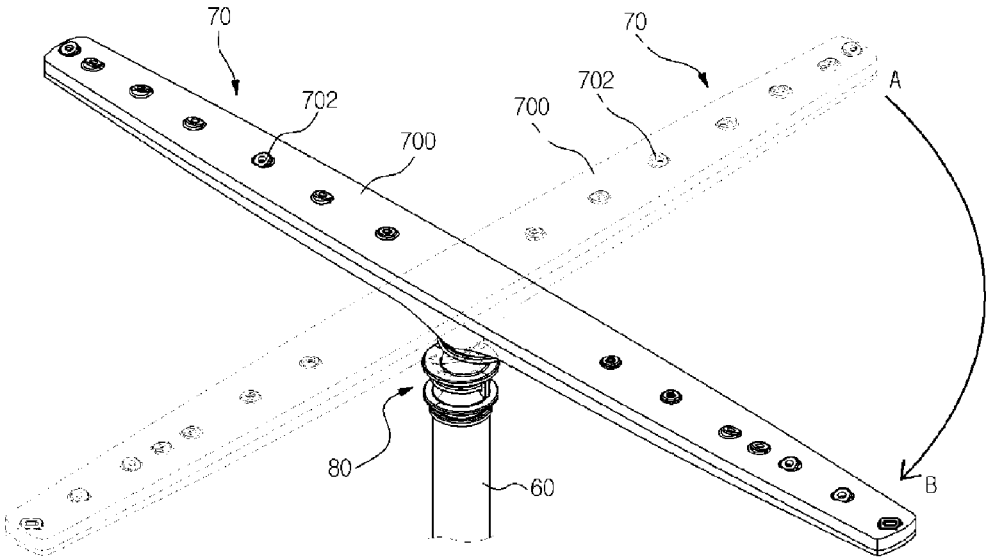
FIG. 10 is a view showing the nozzle assembly according to an embodiment.
Figure 11:
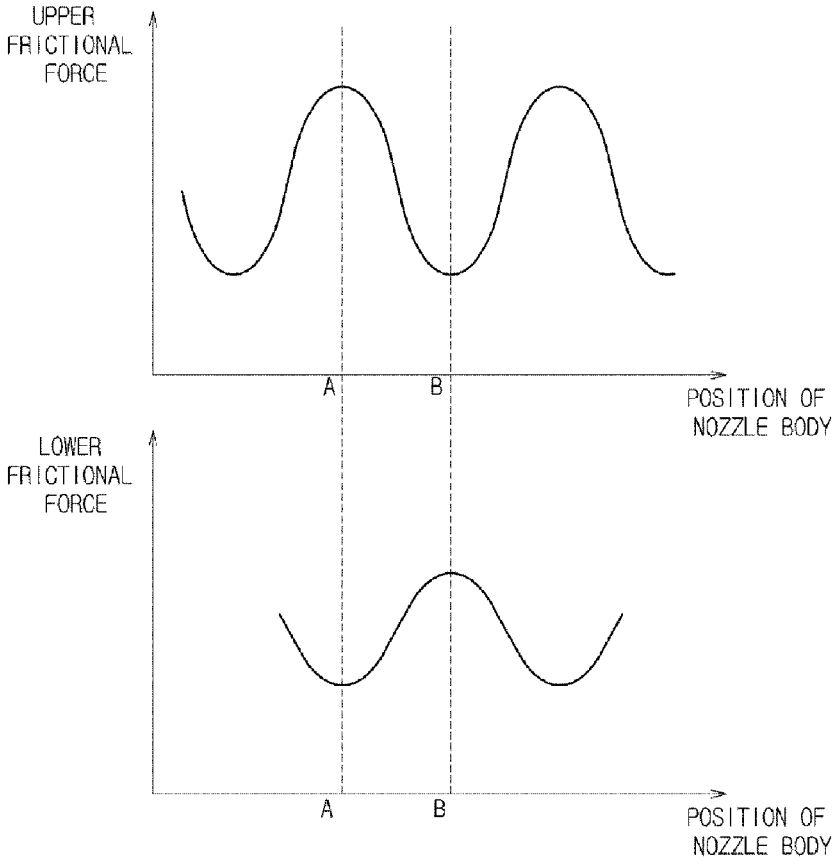
FIG. 11 is a view showing a relation between frictional force and rotating position of the nozzle assembly according to an embodiment.

FIG. 10 is a view showing the nozzle assembly according to an embodiment, and FIG. 11 is a view showing a relation between frictional force and rotating position of the nozzle assembly according to an embodiment.

Referring to FIGS. 10 and 11, the rotation of the nozzle 70 may be adjusted by frictional force (hereinafter, referred to as upper frictional force) between the nozzle body 700 and the first body 811 and frictional force (hereinafter, referred to as lower frictional force) between the second body 813 and the lower rotor arm 82. If wash water is supplied from the sump 30, the nozzle body 700 may obtain propulsive force for rotation by the wash water sprayed from the spray hole 702 formed at the nozzle body 700. Since the section in which the upper frictional force is greater than the lower frictional force and the section in which the upper frictional force is less than the lower frictional force occur by turns, the nozzle body 700 may carry out both revolution and rotation.

In detail, when the nozzle body 700 rotates and is located at a Position A, the lower frictional force between the second body 813 and the lower rotor arm 82 is less than the upper frictional force between the first body 811 and the connecting part 701. At this time, the second body 813 obtains force of rotating in the lower rotor arm 82. That is, the nozzle body 700 obtains force of revolving by the wash water spraying force from the spray hole 702.

As the nozzle body 700 rotates clockwise or counterclockwise from the position A, the upper frictional force decreases and the lower frictional force increases. When the nozzle body 700 is located at a position B, the upper frictional force is less than the lower frictional force. At this time, the nozzle body 700 obtains force of rotating about the axis of the rotation center C1 by the wash water spraying force from the spray hole 702.

As the nozzle body 700 rotates, the nozzle 70 alternately obtains force enabling the nozzle body 700 to revolve and rotate. That is, when the nozzle body 700 is located at the position A, the nozzle 70 obtains force enabling the upper rotor arm 81 to rotate about the axis of the rotation center C2. When the nozzle body 700 is located at the position B, the nozzle 70 obtains force enabling the nozzle body 700 to rotate about the axis of the rotation center C1. The nozzle body 700 and the upper rotor arm 81 may continuously rotate clockwise or counterclockwise between the position A and the position B by inertia. As a result, the nozzle 70 may continuously carry out revolution and rotation.

The RPM of the nozzle body 700 may be adjusted by the upper frictional force between the nozzle body 700 and the upper rotor arm 81. The rotational speed of the nozzle body 700 may be adjusted by a contact area between the inner side surface of the connecting part 701 and the outer side surface of the first body 811. As the contact area increases, the upper frictional force also increases, which causes the nozzle body 700 to rotate slowly. According to an embodiment, the rotational speed of the nozzle body 700 may also be adjusted by the change of the upper frictional force by modifying the angle, number and friction area of the leakage guide 722 provided at the inner side surface of the connecting part 701 or the leakage guide 817 provided at the outer side surface of the first body 811.

The RPM of the upper rotor arm 81 may be adjusted by the lower frictional force between the second body 813 and the lower rotor arm 82. As an area of the friction part 815 provided at the upper rotor arm 81 increases, the upper rotor arm 81 may rotate slowly. That is, because the lower frictional force increases as an area of the friction part 815 provided at the upper rotor arm 81 increases, the upper rotor arm 81 may rotate slowly in the lower rotor arm 82, and the nozzle body 700 may revolve slowly.

A rotation-to-revolution ratio of the nozzle body 700 may be adjusted so as to accomplish optimum dish washing by increasing a spray range of the wash water sprayed from the spray hole 702 according to an environment in which the nozzle 70 is used.

As is apparent from the above description, the nozzle may regularly carry out revolution and rotation, and the revolution and the rotation thereof may be adjusted by modifying a friction area or the like. As a result, the nozzle may be configured to spray wash water over a wider range, and optimum dish washing may be achieved.

Although a few embodiments have been shown and described, it would be appreciated by those skilled in the art that changes may be made in these embodiments without departing from the principles and spirit of the disclosure, the scope of which is defined in the claims and their equivalents.

What is claimed is:

1. A dishwasher comprising:

a sump to pump wash water;

a supply pipe to which the wash water from the sump is supplied; and a nozzle assembly connected to the supply pipe, wherein the nozzle assembly includes:

a lower rotor arm connected to the supply pipe;

an upper rotor arm having a portion rotatably received in the lower rotor arm and having a first rotation center of an upper end thereof and a second rotation center of a lower end thereof positioned eccentrically from the first rotation center; and a nozzle rotatably connected to the upper rotor arm, and wherein the nozzle includes a nozzle body having spray holes.

2. The dishwasher according to claim 1, wherein at least one of the upper rotor arm and the nozzle is provided with a friction part protruding therefrom, and revolutions per minute of the nozzle are adjusted by an area of the friction part.

3. The dishwasher according to claim 1, wherein the upper rotor arm is provided with a friction part protruding from an outer side surface thereof, the friction part being configured to contact an inner side surface of the lower rotor arm, and revolutions per minute of the upper rotor arm are adjusted by an area of the friction part.

4. The dishwasher according to claim 1, wherein frictional force between the upper rotor arm and the lower rotor arm and frictional force between the nozzle and the upper rotor arm alternately increase or decrease.

5. The dishwasher according to claim 4, wherein if the frictional force between the upper rotor arm and the lower rotor arm exceeds the frictional force between the nozzle and the upper rotor arm, the nozzle obtains force of rotating about an axis of the first rotation center of the upper end of the upper rotor arm.

6. The dishwasher according to claim 4, wherein if the frictional force between the upper rotor arm and the lower rotor arm exceeds the frictional force between the nozzle and the upper rotor arm, the upper rotor arm obtains force of rotating about an axis of the second rotation center of the lower end of the upper rotor arm.

7. The dishwasher according to claim 1, wherein the spray holes have directivity at an upper surface thereof, and the nozzle is configured to rotate due to reaction to the wash water sprayed from the spray holes.

8. A nozzle assembly for a dishwasher having a main body, comprising:

a rotor arm provided with a friction part and having a rotation center of an upper end thereof and a rotation center of a lower end thereof positioned eccentrically from the rotation center of the upper end; and a nozzle rotatably mounted to the rotor arm in the main body of the dishwasher, wherein the nozzle includes a nozzle body having spray holes.

9. The nozzle assembly for a dishwasher according to claim 8, wherein the nozzle is provided with a connecting part, to which the rotor arm is connected, at a bottom surface thereof, and the connecting part is provided with a friction part configured to contact the rotor arm.

10. The nozzle assembly for a dishwasher according to claim 8, wherein the rotor arm includes an upper rotor arm connected to the nozzle, and a lower rotor arm in which at least a portion of the upper rotor arm is received.

11. The nozzle assembly for a dishwasher according to claim 10, wherein the friction part is provided at an outer side surface of the upper rotor arm.

12. The nozzle assembly for a dishwasher according to claim 10, wherein the upper rotor arm includes a first body connected to the nozzle, a second body received in the lower rotor arm, and a third body to connect the first body and the second body such that a rotation center of the first body and a rotation center of the second body are positioned eccentrically from each other.

13. The nozzle assembly for a dishwasher according to claim 12, wherein the first body, the second body and the third body are integrally formed by injection molding.

14. The nozzle assembly for a dishwasher according to claim 12, wherein the friction part is provided at an outer side surface of the second body, and is configured to contact an inner side surface of the lower rotor arm.

15. The nozzle assembly for a dishwasher according to claim 14, wherein if wash water is supplied to the nozzle, the upper rotor arm rotates in the lower rotor arm, and revolutions per minute of the upper rotor arm are adjusted by a contact area of the friction part with the inner side surface of the lower rotor arm.

16. The nozzle assembly for a dishwasher according to claim 9, wherein revolutions per minute of the nozzle are adjusted by a contact area of the friction part provided at an inner side surface of the connecting part with the rotor arm.

17. The nozzle assembly for a dishwasher according to claim 12, wherein:

the first body is provided with a fixing part protruding outwardly therefrom, and the nozzle is provided with a hook at a bottom surface thereof, and the upper rotor arm is connected to the nozzle by the hook being hooked to the fixing part.

18. The nozzle assembly for a dishwasher according to claim 12, wherein:

the first body is provided with a hook at a portion thereof, and the lower rotor arm is provided with a fixing part at a portion thereof, and the upper rotor arm is connected to the lower rotor arm by the hook being hooked to the fixing part.

19. The nozzle assembly for a dishwasher according to claim 12, wherein:

the first body is provided with a hook at an upper portion thereof, and the nozzle is provided with a fixing part, to which the hook is hooked, at a bottom surface thereof, and the fixing part is configured as a recess having the same or larger radius than a radius of rotation of the hook in order to avoid interference of the hook when the nozzle rotates.

20. The nozzle assembly for a dishwasher according to claim 8, wherein at least one of the rotor arm and the nozzle is provided with a leakage guide, and the nozzle rotates due to reaction force to water stream generated by the leakage guide.

21. A dishwasher comprising:

a sump to pump wash water;

a supply pipe to which the wash water from the sump is supplied; and a nozzle assembly connected to the supply pipe, wherein the nozzle assembly includes:

a rotor arm provided with a friction part and having a rotation center of an upper end thereof and a rotation center of a lower end thereof positioned eccentrically from the rotation center of the upper end; and a nozzle rotatably mounted to the rotor arm, and wherein the nozzle includes a nozzle body having spray holes.

* * * * *